United States Patent [19]

Kobayashi et al.

[11] Patent Number: 4,561,399

[45] Date of Patent: Dec. 31, 1985

[54] METHOD OF CONTROLLING AIR-FUEL RATIO

[75] Inventors: Nobuyuki Kobayashi; Takashi Hattori, both of Toyota, Japan

[73] Assignee: Toyota Jidosha Kabushiki Kaisha, Toyota, Japan

[21] Appl. No.: 643,711

[22] Filed: Aug. 24, 1984

[30] Foreign Application Priority Data

Aug. 30, 1983 [JP] Japan ..... 58-158882

[51] Int. Cl.[4] ..... F02M 7/00

[52] U.S. Cl. ..... 123/478; 123/480

[58] Field of Search ..... 123/478, 480, 440, 489, 123/486, 438, 436

[56] References Cited

U.S. PATENT DOCUMENTS

| | | | |
|---|---|---|---|
| 4,442,815 | 4/1984 | Ninomiya | 123/480 |
| 4,495,921 | 1/1985 | Sawamoto | 123/480 |
| 4,495,925 | 1/1985 | Hasegawa | 123/480 |
| 4,502,442 | 3/1985 | Takakawa et al. | 123/480 |
| 4,522,178 | 6/1985 | Amano et al. | 123/478 |

*Primary Examiner*—Raymond A. Nelli

*Attorney, Agent, or Firm*—Cushman, Darby & Cushman

[57] ABSTRACT

There is disclosed a control of learning correction coefficient compensating an aging of the air flow meter and a high altitude of highlands where the motor vehicle travels. A lower limit for a altitude compensating learning correction coefficient FHAC is computed by use of the altitude compensating learning correction coefficient FHAC determined during idling of the engine. A feedback correction coefficient FAF is determined such that it gets greater as the air-fuel ratio becomes smaller than the stoichiometric level of air-fuel ratio and it gets smaller as the air-fuel ratio becomes greater than the stoichiometric level of air-fuel ratio. When the mean value FAFAV1 of the feedback correction coefficient FAF is equal to the predetermined value or more, the altitude compensating learning correction coefficient FHAC is increased. Whereas, the mean value FAFAV1 is less than the predetermined value, the altitude compensating learning correction coefficient FHAC is decreased. The altitude compensating learning correction coefficient FHAC is not exceeded the lower limit therefor.

12 Claims, 10 Drawing Figures

METHOD OF CONTROLLING AIR-FUEL RATIO

BACKGROUND OF THE INVENTION

This invention relates to a method of controlling an air-fuel ratio, and more particularly to a method of controlling an air-fuel ratio, suitable for use in an internal combustion engine for a vehicle, having an electronically controlled fuel injection device.

In an electronically controlled fuel injection device, a basic fuel injection time duration TP is computed on the basis of an engine speed NE detected by a rotational speed sensor and an intake air flowrate Q detected by an intake air flow sensor, and various correction are applied to the basic fuel injection time duration TP in accordance with the engine operating conditions so as to compute a final fuel injection time duration $\tau$. A fuel injection valve is opened to inject the fuel for the final fuel injection time duration $\tau$.

On the other hand, in the fuel injection control device of the type described, in which CO, HC and $NO_x$ are to be simultaneously removed for the exhaust gas emission control measure, it is desired to control the air-fuel ratio in the vicinity of the stoichiometric air-fuel ratio from the viewpoint of the effective removal of the above-mentioned three contents. Therefore, an oxygen sensor is provided in the exhaust gas path, and, under predetermined condition, the feedback correction coefficient FAF is computed so that the air-fuel ratio can approach the vicinity of the stoichiometric air-fuel ratio in accordance with an air-fuel ratio signal from the oxygen sensor, whereby the air-fuel ratio is feedback-controlled.

In the electronically controlled fuel injection device wherein the above-described feedback control of the air-fuel ratio, the air-fuel ratios under the predetermined conditions during the above-described feedback control are learned to compute learning correction coefficient FG in order to compensate a difference in the air-fuel ratio due to the variability of parts, compensate the air-fuel ratio for the running of the vehicle in the highlands (for the high altitude) and compensate a variation in the air-fuel ratio due to change of the intake air flow sensor with time.

For example, the final fuel injection time duration $\tau$ is obtainable through the following equation.

$$\tau = TP \times FAF \times FG \times K$$

where K is a correction coefficient determined by water temperature, intake air temperature and the like.

In learning the aforesaid air-fuel ratio, it must be taken in consideration that the fuel, which has evaporated from a fuel tank and has been accumulated in a canister (hereinafter referred to as the "evaporated fuel"), is fed to a combustion chamber under predetermined condition including that at least the throttle valve is not fully closed, and thus the air-fuel ratio becomes rich temporarily. The influence by the evaporated fuel upon the air-fuel ratio is as shown in FIG. 1. In an extreme case, the intake air flowrate Q becomes about 10% rich even in a region of a high air flowrate as high as 100 $m^3/h$. In consequence, if the operation of the vehicle is stopped immediately after the change in the air-fuel ratio due to the evaporated fuel as described above is learned, then the air-fuel ratio would become excessively lean when the vehicle is started again, thus presenting the disadvantage of lowered startability. For this reason, there is no need to learn the air-fuel ratio, which has become rich due to the evaporated fuel.

The compensation of the air-fuel ratio for the aforesaid high altitude prevents the air-fuel ratio from becoming richer. More specifically, since the higher the altitude is, the lower the air density becomes, the air-fuel ratio becomes richer when the vehicle runs at the high-lands. Therefore, in the compensation for the high altitude, the fuel injection rate is adapted to get less as the altitude becomes higher. The influence by the altitude of the high-lands upon the air-fuel ratio is substantially constant irrespective of the intake air flowrate as shown in FIG. 2. Because of this, in a region other than the region where the throttle valve is fully closed, it is difficult to attribute the air-fuel ratio being rich to whether the evaporated fuel or the altitude of the high-lands.

On the other hand, when the intake air flow sensor is obstructed due to the change with time or the like, the deeper influence is exerted on the air-fuel ratio in the intake air flow rate being lesser, as shown in FIG. 3. There has been proposed the control method in which, when the air-fuel ratios between a region where the throttle valve is fully closed and a region other than the above differ by 15% or more, the obstruction of the intake air flow sensor is judged to be present and a subtraction is made from the learning correction coefficient so that the air-fuel ratio can be $\lambda$(surplus rate of air)=1. In the conventional control method, the similar learning is carried out even when the difference of 15% or more of air-fuel ratio occurs due to the evaporated fuel affecting the air-fuel ratio in accordance with air flow rate as in FIG. 1. As a result, the compensation of the air-fuel ratio due to the change with time and the compensation of the air-fuel ratio due to the evaporated fuel are overlapped, so that it is difficult to carry out the compensation of the air-fuel ratio properly. Further, when the vehicle comes down from the highland with the throttle valve being fully closed, there is a possibility of that the obstruction compensation cannot be correctly carried out.

SUMMARY OF THE INVENTION

An object of a first aspect of the invention is to provide a method of controlling an air-fuel ratio, wherein, in compensating the air-fuel ratio on the highland, the influence by the evaporated fuel on the air-fuel ratio can be prevented from being exerted.

An object of a second aspect of the invention is to provide a method of controlling an air-fuel ratio, wherein, in compensating the air-fuel ratio due to the obstruction of the intake air flow sensor, the influence by the evaporated fuel can be prevented from being exerted.

The first aspect of the invention features that a lower limit for the altitude compensating learning correction coefficient FHAC is computed by use of the altitude compensating learning correction coefficient FHAC determined during idling of the engine. A feedback correction coefficient FAF is determined such that it gets greater as the air-fuel ratio becomes smaller than the stoichiometric level of air-fuel ratio and it gets smaller as the air-fuel ratio becomes greater than the stoichiometric level of air-fuel ratio. When the mean value FAFAV1 of the feedback correction coefficient FAF is equal to a predetermined value therefor or more, the altitude compensating learning correction coefficient FHAC is increased. Whereas, the mean value FAFAV1 is less than the predetermined value, the altitude compensating learning correction coefficient FHAC is decreased. The lower limit is determined in accordance with the altitude compensating learning correction coefficient FHAC. Accordingly, even if the evaporated fuel is fed to the combustion chamber when the throttle valve is not fully closed to temporarily make the air-fuel ratio rich and thus compensating learning correction coefficient FHAC reaches a comparatively high value, the lower limit of the correction coefficient FHAC has been determined, so that the influence on the learning of correction coefficient FHAC by the evaporated fuel can be prevented.

The second aspect of the invention features that an obstruction compensating learning correction coefficient DFC is rewritten to be learnt when the throttle valve is fully closed and a reference value FAFAV2 is within a predetermined range. The reference value FAFAV2 is adapted to approach the mean value FAFAV1 of the feedback correction coefficient FAF when the throttle valve is not fully closed. When the mean value FAFAV1 is a predetermined value therefor or more, the learning correction coefficient DFC is increased and, whereas, when the mean value FAFAV1 is less than the predetermined value, the oorrection coefficient DFC is decreased. A predetermined amount is added to the reference value FAFAV2 after the learning correction coefficient DFC is rewritten. Accordingly, even if the evaporated fuel is fed to the combustion chamber when the throttle valve is not fully closed to temporarily make the air-fuel ratio rich, in compensating the air-fuel ratio due to the obstruction of the intake air flow sensor, the influence by the evaporated fuel can be prevented from being exerted. Further, when the fully closed state of the throttle valve is protracted for a long period of time, e.g. when the vehicle comes down from the highlands with braking exerted from the engine, the obstruction compensating learning correction coefficient DFC is prevented from being continuously computed, so that a possibility of receiving the influence by the altitude of the highlands can be eliminated.

DESCRIPTION OF THE PREFERRED EMBODIMENT

Figure 1:
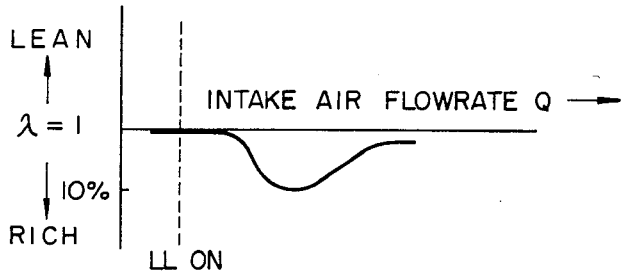
FIG. 1 shows the influence of the air-fuel ratio of the evaporated fuel.
Figure 2:
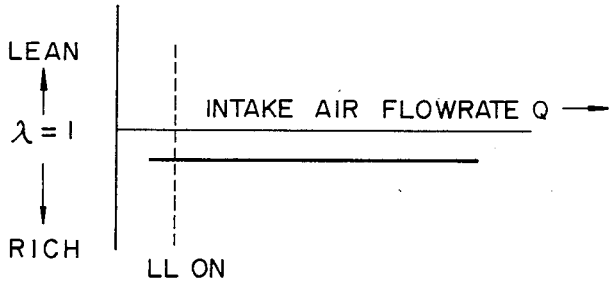
FIG. 2 shows the influence of the air-fuel ratio due to the highland.
Figure 3:
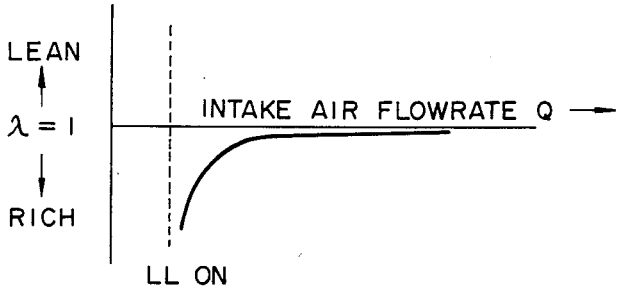
FIG. 3 shows the influence of the air-fuel ratio due to the obstruction of an intake air flowrate.
Figure 4:
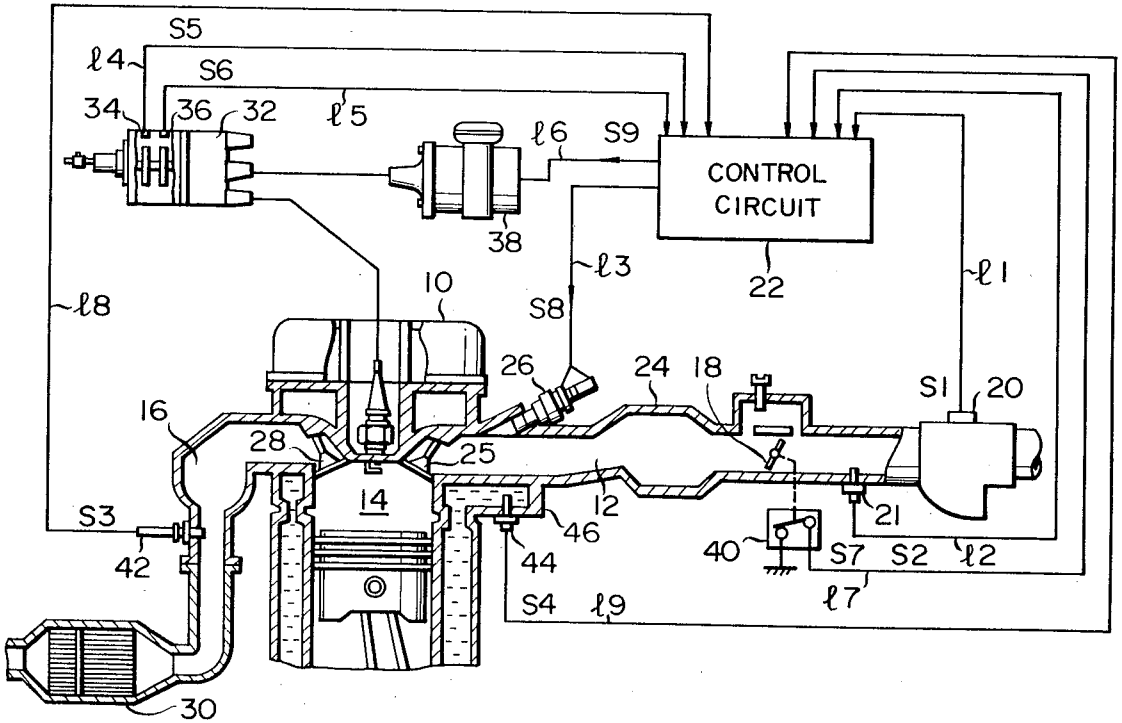
FIG. 4 is a block diagram showing an example of the internal combustion engine, to which the present invention is applied.

FIG. 4 shows an example of an electronically control fuel injection type internal combustion engine, to which the present invention is applied. Designated at 10 is a main body of engine, 12 an intake passage, 14 a combustion chamber, and 16 an exhaust passage, respectively. An intake air flow sensor (air flow meter) 20 provided in the intake passage 12 upstream of the throttle valve 18 is connected to a control circuit 22 through a signal line 11, for generating a voltage commensurate to an intake air flowrate. An intake air temperature sensor 21 is provided in the intake passage 12 upstream of the throttle valve 18 and connected to the control circuit 22 through a signal line 12, for generating a voltage commensurate to intake air temperature. Intake air taken in through an air cleaner (not shown) and the intake air flow sensor 20 and controlled in its flowrate by the throttle valve 18 operationally associated with an accelerator pedal (not shown) is led to combustion chambers 14 of respective cylinders through a surge tank 24 and an inlet valve 25.

The fuel injection valves 26 are provided on every cylinders and on-off operated in accordance with electrical driving pulses fed from the control circuit 22 through a signal line 13. In response to the pulses, the fuel injection valves 26 intermittently inject pressurized fuel fed from a fuel supply system (not shown) into the intake passage 12 in the vicinity of the intake valve 25, i.e. an intake port portion. The exhaust gas after the combustion in the combustion chamber 14 is discharged to atmosphere via exhaust valves 28, the exhaust passage 16 and a three-way catalytic converter 30.

Mounted on a distributor 32 of the engine are crank angle sensors 34 and 36, which are connected to the control circuit 22 via signal lines 14 and 15. These sensors 34 and 36 produce pulse signals each time the crankshaft rotates through 30° and 360°, respectively, and the pulse signals are delivered to the control circuit 22 through a signal line 16.

Designated at 40 is an idle switch (LL switch) operationally associated with the throttle valve 18, for being closed when the throttle valve 18 is fully closed, and connected to the control circuit 22 through a signal line 17.

In the exhaust passage 16, there is provided an $O_2$ sensor for producing a signal in response to the concentration of oxygen in the exhaust gas, i.e. generating output voltage which stepwise changes around the stoichiometric air-fuel ratio, and the output signal is delivered to the control circuit 22 through a signal line 18. The three-way catalytic converter 30 is provided downstream of this $O_2$ sensor 42 and simultaneously purifies the three harmful contents in the exhaust gas, i.e. HC, CO and $NO_x$.

Furthermore, denoted at 44 is a water temperature sensor for detecting a coolant temperature of the engine, mounted on a cylinder block 46, and connected to the control circuit 22 through a signal 19.

Figure 5:
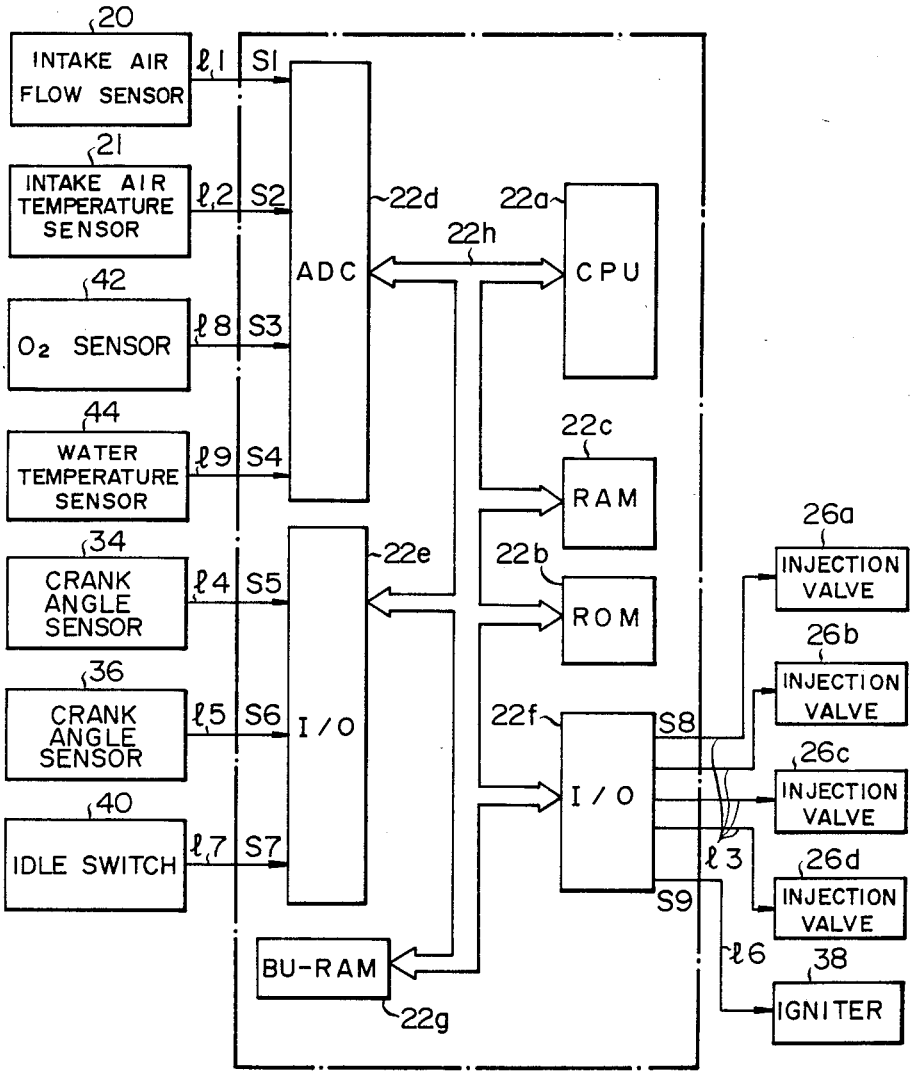
FIG. 5 is a block diagram showing the detailed example of the control circuit thereof.

As shown in FIG. 5, the control circuit 22 comprises: a central processing unit (CPU) **22*a* for controlling various components; a read only memory (ROM) 22*b*, into which various numerical values and programs are previously written; a random access memory 22*c*, in which numerical values and flags obtained during computation process are written into a predetermined area; an A/D converter (ADC) 22*d* having an analogue multiplexer function, for converting an analogue input signal into a digital signal; an input/output interface (I/O) 22e, into which various digital signals are inputted; an input/output interface (I/O) 22f for outputting various digital signals; a backup memory (BU-RAM) 22g for being supplied with electricity from an auxiliary power source when the engine is out of operation to maintain the memory; and a bus line 22h** for connected the above-described components to one another.

In the ROM 22b, there are previously stored a main process routine program, a program for computing a fuel injection time duration (pulse-width), a program for computing an air-fuel ratio feedback correction coefficient and a learning correction coefficient to be described hereunder, other various programs and various data necessary for computation of the above programs.

The air flow meter 20, the intake air temperature sensor 21, the $O_2$ sensor 42 and the water temperature sensor 44 are connected to the A/D converter 22d, whereby voltage signals S1, S2, S3 and S4 from the respective sensors are successively converted into binary signals in response to the instructions from CPU 22a.

A pulse signal S5 from the crank angle sensor 34 through each crank angle 30°, a pulse signal S6 from the crank angle sensor 36 through each crank angle 360° and an idle signal S7 from an idle switch 40 are taken into the control circuit, respectively, through the I/O 22e. A binary signal representing an engine speed is formed in response to the pulse signal S5, and the pulse signals S5 and S6 cooperate with each other to form a signal required for the computation of the fuel injection pulse-width, an interruption signal for beginning the fuel injection, a cylinder identification signal and the like. Furthermore, it is judged whether the throttle valve 18 is substantially fully closed or not by the idle signal S7.

A fuel injection signal S8 and an ignition signal S9, which have been formed by various computations, are delivered from the I/O 22f to fuel injection valves 26a–26d and an igniter 38, respectively.

A fuel injection time duration (quantity of injection) in an internal combustion engine with the above-described arrangement is determined by the following formula for example.

$$\tau = TP \times FAF \times FG \times K \quad (1)$$

where $\tau$ is the final fuel injection time duration,

TP a basic fuel injection time duration,

FAF a feedback correction coefficient,

FG a learning correction coefficient, and

K a correction coefficient by water temperature, intake air temperature and the like.

The basic fuel injection time duration TP is read from a predetermined table or obtained by computations on the basis of an intake air flowrate Q and an engine speed NE.

Under the feedback control condition, if the air-fuel ratio is judged to be lean in response to the air-fuel ratio signal S3 from the $O_2$ sensor 42, then the feedback correction coefficient FAF comes to be a value to increase the quantity of fuel injection, e.g. 1.05. If the air-fuel ratio is judged to be rich in response to the air-fuel ratio S3, then the feedback correction coefficient FAF comes to be a value to reduce the quantity of injection, e.g. 0.95. Not under the condition of feedback, the correction coefficient FAF comes to be 1.0.

Figure 6:
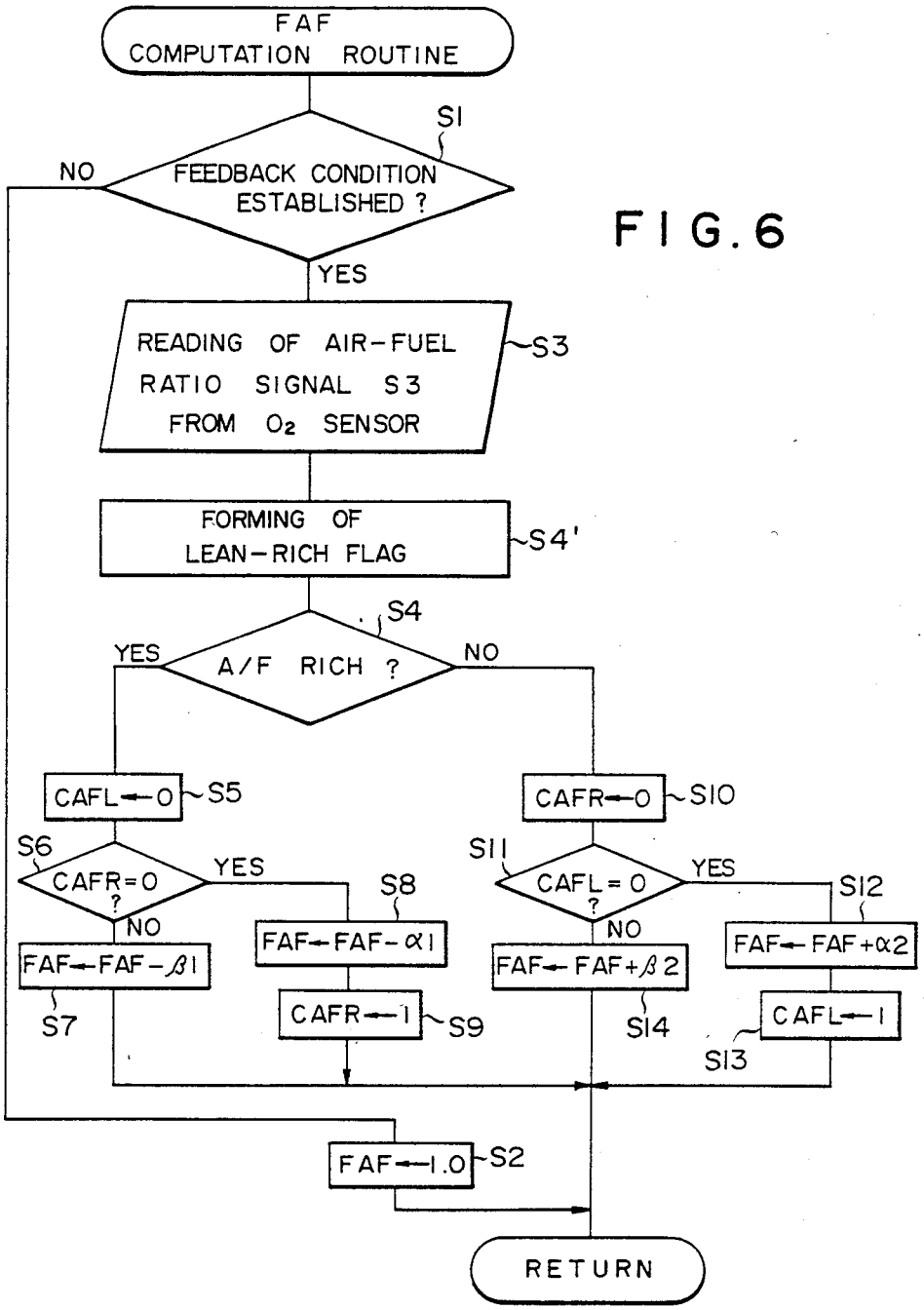
FIG. 6 is a flow chart showing an example of the feedback correction coefficient.

FIG. 6 shows an example of the computation steps of the feedback correction coefficient.

In a step S1, it is judged if the feedback control condition is established or not. The feedback control condition is established, when it is not the starting condition, not during the increase of the fuel flow rate after the start of the engine, engine water temperature THW is 50° C. or more, and not during the increase of the fuel flow rate for acceleration, for example. If the feedback control condition is not established, then, in a step S2 the feedback correction coefficient FAF is set at 1.0 not to allow the feedback control to be effected, thus ending this routine. If the feedback control condition is established, then the process proceeds to a step S3. In a step S3, the air-fuel ratio is read on the basis of the signal S3. In a step S4, an air-fuel ratio lean-rich flag is formed in accordance with a voltage value represented by the air-fuel ratio signal S3. When the air-fuel ratio is rich, the flag is set to be "1" and, when the air-fuel ratio is lean, the flag is reset to be "0". In a step S4, when the flag indicates "1", the air-fuel ratio is judged to be rich, and a process goes to successive steps where an air-fuel mixture is adapted to get leaner.

More specifically, in a step S5, a flag CAFL is set to be zero, and the process proceeds to a step S6 in which a judgement is made as to whether or not the flag CAFR is zero. When the air-fuel mixture is shifted to the rich side for the first time, since the flag CAFR has come to be zero, the process proceeds to a step S8 in which a predetermined value $\alpha 1$ is subtracted from the correction coefficient FAF stored in the RAM 22b. The result of the subtractive calculation is made to be the new correction coefficient FAF. In a step S9, the flag CAFR is made to be 1. In consequence, when the air-fuel ratio is judged to be rich continuously twice or more in the step S4, in the step S6 through which the process passes through after the two times, the negative judgement is made without fail. In the step S7, a predetermined value $\beta 1$ is subtracted from the correction coefficient FAF and the result of calculation is made to be the new correction efficient FAF, thus finishing this computing process.

On the other hand, the lean-rich flag based on the voltage represented by the signal S3 in the step S4 is "0", the air-fuel ratio is judged to be lean, so that a process of shifting the air-fuel ratio to the rich side is conducted. More specifically, the flag CAFR is set to be zero in a step 10 and the process proceeds to a step S11 in which a judgement is made whether or not the flag CAFR is zero. When the air-fuel mixture is shifted to the leaner side for the first time, the process proceeds to a step S12 because the flag CAFL has set to be "0". In the step S12, a predetermined value $\alpha 2$ is added to the correction coefficient FAF and the result of calculation is made to be the new correction coefficient FAF. In a step S13, the flag CAFL is made to be 1. In consequence, if the air-fuel ratio is judged to be lean continuously two or more times, then, in the step S11 through which the process passes through the two times, the negative judgement is made without fail. In a step S14, a predetermined value $\beta 2$ is added to the correction coefficient FAF and the result of calculation is made to be the new correction efficient FAF, thus completing the computation of FAF.

Additionally, $\alpha 1$, $\alpha 2$, $\beta 1$ and $\beta 2$ in the steps S7, S8, S12 and S14 are predetermined values, respectively.

Figure 7:
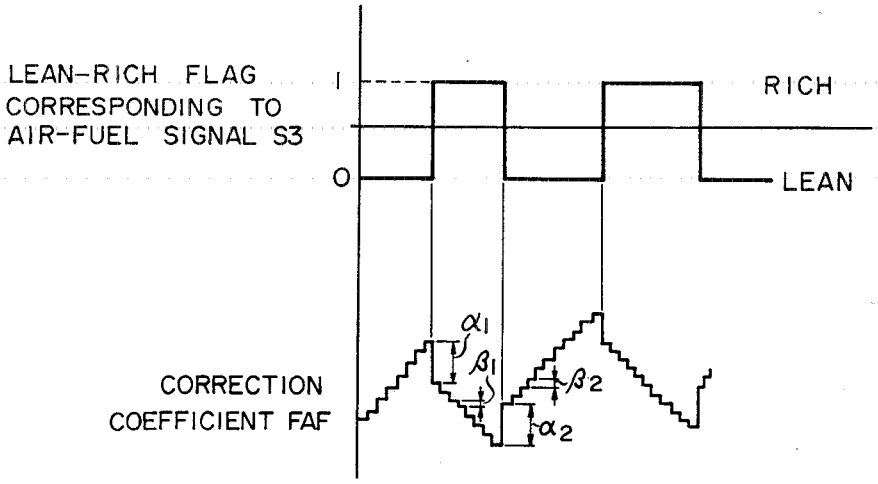
FIG. 7 is a time chart showing the flog and the correction coefficient FAF in accordance with the air-fuel ratio S3.

FIG. 7 shows the feedback correction coefficient FAF obtained from this computing steps and a lean-rich flag corresponding to the voltage value indicated by the air-fuel ratio signal S3. Referring to this drawing, when the air-fuel ratio is shifted from lean to rich or from rich to lean, the correction coefficient FAF is skipped by $\alpha 1$ or $\alpha 2$. If the air-fuel ratio is kept lean, then a predetermined number $\beta 1$ is successively added to the correction coefficient FAF, whereas, if the air-fuel ratio is kept rich, then a predetermined number $\beta 2$ is successively subtracted from the correction coefficient FAF.

A learning correction coefficient FG to be determined according to the control method according to the present invention can be represented by the following formula.

$$FG=(1+FHAC+DEC/Q) \quad (2)$$

where, FHAC represents the altitude compensating learning correction coefficient, DFC represents the obstruction compensating learning correction coefficient of the air flow meter, and Q represents the quantity of intake air.

Figure 8:
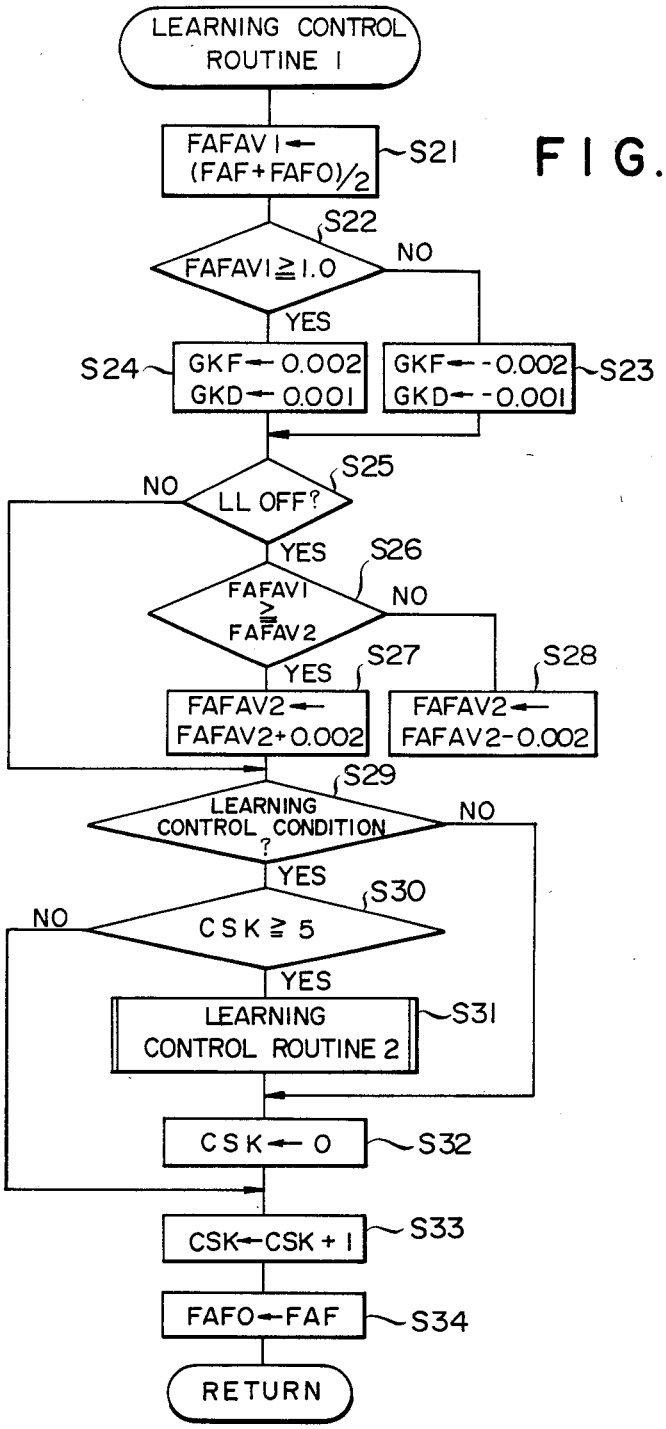
FIG. 8, 9 and 10 are flow charts showing each one example of the learning control of the method according to the present invention.
Figure 9:
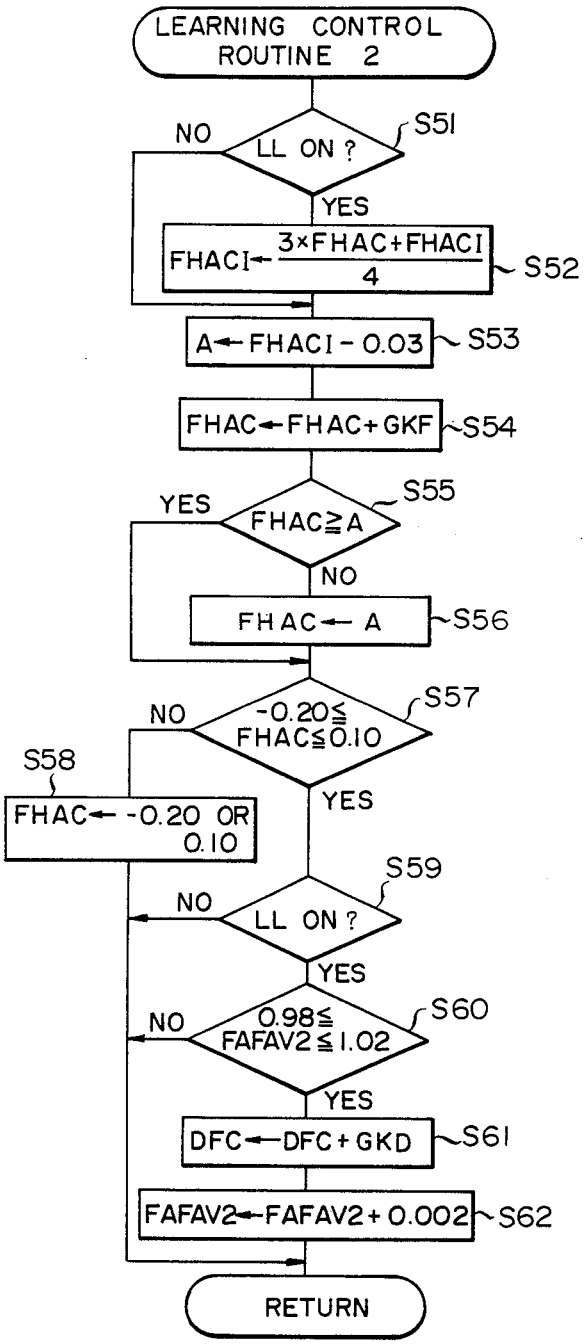
Figure 10:
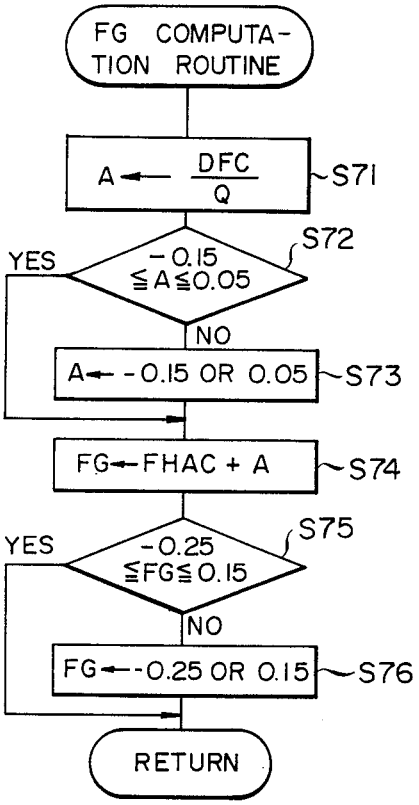

The learning correction coefficient FG is computed in accordance with the routines described in FIGS. 8, 9 and 10.

The learning control routine 1 shown in FIG. 8 is started each time the aforesaid correction coefficient FAF is skipped. In a step S21, calculation is made to determine an arithmetical mean value FAFAV1 between the correction coefficient FAF previously obtained and the correction coefficient FAFO now obtained, i.e. the two new and old values. The process proceeds to a step S22 in which judgement is made as to whether or not the mean value FAFAV1 is 1 or more. If the mean value FAFAV1 is less than 1, then, in a step S23, an altitude compensating learning amount GKF for the altitude compensation is set at "−0.002" and learning amount GKD for the obstruction compensating is set at "−0.001". If the mean value FAFAV1 is 1 or more, then, in a step S24, the altitude compensating amount GKF is set at "0.002" and the obstruction compensating amount GKD is set at "0.001".

In a step S25, a judgement is made as to whether or not the throttle valve 18 is fully closed in response to the idle signal S7. If the judgement is affirmative, then the process proceeds to a step S26 in which the aforesaid mean value FAFAV1 is equal to the obstruction compensating learning reference value FAFAV2 or more. The reference value FAFAV2 is set at "1" at the time of starting of the engine and increased or decreased under a predetermined condition. If the mean value FAFAV1 is equal to the reference value FAFAV2 or more, then, in a step S27, "0.002" is added to the reference value FAFAV2. If the mean value FAFAV1 is less than the reference value FAFAV2, then, in a step S28, "0.002" is subtracted from the reference value FAFAV2.

If the judgement is negative in the step S25 or the step S27 and S28 are finished, then, the process proceeds to a step S29. In the step S29, a judgement is made as to whether or not the learning control condition is satisfied. The learning control condition is satisfied when at least the air-fuel ratio is feedback controlled. In addition to it, for example, when the temperature of the engine cooling water is 80° C. or more, the learning control condition is satisfied. If the judgement is affirmative in the step S29, then, the process proceeds to a step S30 in which a judgement is made as to whether or not the counted number of a counter CSK for counting a number of skips of the correction coefficient FAF is 5 or more. If the judgement is affirmative in the step S30, then, the process proceeds to a step S31 in which a learning control routine 2 shown in FIG. 9 is carried out. Then, in a step S32, the counter CSK is reset to be "0".

If the judgement is negative in the step S30 or the step S32 is completed, then, the process proceeds to a step S33 in which the counter CSK is caused to count up by +1. In a step 34, the preceding correction coefficient FAFO is made to be the newset correction coefficient FAF, thus completing this routine.

Description will hereunder be given of the learning control routine in a step S31 with reference to FIG. 9.

When this routine is started, in a step S51, a judgement is made as to whether or not the throttle valve 18 is fully closed on the basis of the idle signal S7. If the judgement is affirmative in the step S51, the process proceeds to a step S52. If the judgement is negative in the step S51, the process proceeds to a step S53. In the step S52, by use of the latest data of the correction coefficient FHAC and the latest data of a guard value FHACI which is computed only when the throttle valve 18 is fully closed, the following formula is computed and the result of computation is made to be the latest guard value FHACI.

$$(3\times FHAC+FHACI)/4$$

In the step S53, 0.03 is subtracted from the latest guard value FHACI obtained in the step S52, the result of computation is stored in an A register as a lower limit for the learning correction coefficient FHAC. In a next step S54, a learning amount GKF set in the step S23 or S24 in the routine shown in FIG. 8 is added to the correction coefficient FHAC and the result of computation is made to be the latest correction coefficient FHAC. Subsequently, in a step S55, a judgement is made as to whether or not the correction coefficient FHAC is equal to the value stored in the A register or more. If the judgement is negatived, then the process proceeds to a step S56, and, if the judgement is affirmative, then the process proceeds to a step S57. In other words, if the correction coefficient FHAC is less than (the guard value FHACI - 0.03), then, in the step S56, the correction coefficient FHAC is limited by (the guard value FHACI - 0.03).

In the step S57, a judgement is made as to whether the correction coefficient FHAC is −0.20 or more and is 0.10 or less. If the correction coefficient FHAC is not included within such a range as described above, the process proceeds to a step S58 in which the correction coefficient FHAC is limited by −0.20 or 0.10. That is, the correction coefficient FHAC is not exceeded −0.20 or 0.10. Accordingly, if the negative answer is given in the step S57, the learning of the obstruction compensating learning correction coefficient DFC is not conducted. If the positive answer is given in the step S57, the process proceeds to a step S59. In the step S59, a judgement is made as to whether or not the throttle valve 18 is fully closed. If fully closed, then, in a step S60, a judgement is made as to whether the reference value FAFAV2 is 0.98 or more and 1.02 or less. If the reference value FAFAV2 is within this range, then, in a step S61, the learning amount GKD set in the step S23 or S24 in the routine shown in FIG. 8 is added to the obstruction compensating correction coefficient DFC. Then, in a step S62, 0.002 is added to the reference value FAFAV2, thus finishing this routine.

Description will hereunder be given the routine of computing the learning correction coefficient FG with reference to FIG. 10. The learning correction coefficient FG is used when the fuel injection time duration $\tau$ is computed in accordance with the formula (1).

When this routine is started, in a step S71, the latest correction coefficient DFC obtained in the step S61 of the routine shown in FIG. 9 is divided by an intake air flowrate Q per unit hour computed in response to the signal S3 from the air flowmeter and the result of computation is stored in the A register. Subsequently, in a step S72, a judgement is made as to whether or not the value of the A register is −0.15 or more and 0.05 or less. If the value of the A register is not within this range, then, in a step S73, the value of the A register is guarded at −0.15 or 0.05. Then, the process proceeds to a step S74. On the other hand, when the value of the A register is within the range in the step S72, the process proceeds to the step S74.

In the step S74, the value of the A register is added to the latest correction coefficient FHAC, which has been obtained in the step S56 or S58 of the routine shown in FIG. 9, so that the learning correction coefficient FG is determined. In a step S75, a judgement is made as to whether or not the learning correction coefficient FG is −0.25 or more and 0.15 or less. When the learning correction coefficient FG is within the range, this routine is completed. Whereas, when the learning correction coefficient FG is not within the range, the learning correction coefficient FG is guarded at −0.25 or 0.15 in a step S76, and this routine is finished.

The final fuel injection time duration $\tau$ is determined by the formula (1) by use of the feedback correction coefficient FAF and the learning correction coefficient FG obtained as described above. A fuel injection signal S8 having a pulse width corresponding to this final fuel injection time duration $\tau$ is formed and the injection valve 26 is driven in response to the signal S8 thus formed.

In this embodiment, the learning amount GKF of the altitude compensating learning correction coefficient FHAC is set at 0.002 and the learning amount of the obstruction compensating learning correction coefficient DFC is set at 0.001. Therefore, the learning speed of the altitude compensating learning correction coefficient FHAC is adapted to be faster than that of the obstruction compensating learning correction coefficient DFC. This causes the advantage that even when the altitude is comparatively quickly varied at the time of climbing the highlands for example, an altitude compensation with a satisfactorily high response can be carried out. On the other hand, since the variation of obstruction in the air flow meter is very slow, the compensation for the obstruction of the air-flow meter can be satisfactorily conducted by the obstruction compensating learning correction coefficient DFC, although it is highly slowly changed.

Further, the guard value FHACI is computed on the basis of the altitude compensating learning correction coefficient FHAC at the time of idling operation being free from the influence of the air-fuel ratio due to the evaporated fuel, i.e. at the time of full closing of the throttle valve. The altitude compensating learning correction coefficient FHAC at a time other than the time of full closing of the throttle valve is guarded at a value obtained by subtracting 0.03 from the guard value FHACI thus computed. Accordingly, the influence upon the altitude compensation by the evaporated fuel can be avoided.

Furthermore, in the embodiment, an initial value of the reference value FAFAV2 is set at 1, and adapted to approach the mean value FAFAV1 and 0.001 is added to the obstruction compensating learning correction coefficient DFC or 0.001 is subtracted therefrom during idling and when the reference value is $0.98 \leqq DFC \leqq 1.02$. In addition to this, after such an additive computation, 0.002 is added to the reference value FAFAV2. Therefore, the influence due to the highlands and the evaporated fuel can be avoided at the time of learning the correction efficient DFC. For example, when the motor vehicle comes down from the highland with the throttle valve being fully closed, it becomes necessary to learn only the altitude compensating learning correction coefficient FHAC and not to learn the obstruction compensating learning correction coefficient DFC. According to this embodiment, such a requirement as described above can be satisfied.

What is claimed is:

1. A method of controlling an air-fuel ratio comprising the steps of:

determining a basic fuel injection time duration on the basis of an engine load and an engine speed;

determining a feedback correction coefficient in accordance with a measured air-fuel ratio so that the air-fuel ratio becomes a stoichiometric air-fuel ratio under a predetermined feedback condition;

increasing an altitude compensating learning correction coefficient when a mean value of the feedback correction coefficient reaches a predetermined value or more, and, decreasing the altitude compensating learning correction coefficient when the mean value is less than the predetermined value;

determining a lower limit on the basis of the altitude compensating learning correction coefficient determined during idling of a motor vehicle so as not to bring the altitude compensating learning correction coefficient into a value less than the lower limit; and determining a final fuel injection time duration in accordance with the basic fuel injection time duration and the altitude compensating learning correction coefficient, whereby fuel is injected for the final fuel injection time duration.

2. A method of controlling an air-fuel ratio as set forth in claim 1 further comprising the steps:

determining, when the throttle valve is fully closed, a guard value on the basis of the altitude compensating learning correction coefficient such that it approach the altitude compensating learning correction coefficient, wherein the lower limit is determined by subtracting a predetermined value from the guard value.

3. A method of controlling an air-fuel ratio as set in claim 1, wherein, when the measured air-fuel ratio is on the rich side, the feedback correction coefficient is computed in a manner to approach a value less than 1.0 and, when the measured air-fuel ratio is on the lean side, the feedback correction coefficient FAF is computed in a manner to approach a value being 1.0 or more.

4. A method of controlling an air-fuel ratio as set forth in claim 1, wherein:

the air-fuel ratio is detected by an oxygen sensor for outputing an air-fuel ratio signal in acoordance with a concentration of oxygen in the exhaust gas, said air-fuel ratio signal being low level when the concentration of oxygen is high and being high level when the concentration of oxygen is low;

when the air-fuel ratio signal becomes lower than a predetermined reference value, a comparatively high value is added to the feedback correction coefficient to be skipped, and until the air-fuel ratio reaches the predetermined reference value or more, a comparatively low value is added to the feedback correction coefficient; and when the air-fuel ratio reaches the predetermined reference value or more, a comparatively high value is subtracted from the feedback correction coefficient to be skipped, and until the air-fuel ratio becomes lower than the predetermined reference value, a comparatively low value is subtracted from the feedback correction coefficient.

5. A method of controlling an air-fuel ratio as set forth in claim 4, wherein the mean value of the feedback correction coefficient is computed by an airthmetical mean of the feedback correction coefficients immediately before two successive skips of the feedback correction coefficient.

6. A method of controlling an air-fuel ratio as set forth in claim 5, wherein when the mean value is 1 and more, a predetermined number is added to the altitude compensating learning correction coefficient, and when the mean value is less than 1, the predetermined number is subtracted from the altitude compensating learning correction coefficient.

7. A method of controlling an air-fuel ratio comprising the steps of:

determining a basic fuel injection time duration on the basis of an intake air flowrate and an engine rotational speed;

determining a feedback correction coefficient in accordance with a measured air-fuel ratio so that the air-fuel ratio becomes a stoichiometric air-fuel ratio under a predetermined feedback condition;

determining, when a throttle valve is fully closed, a reference value such that it approaches a mean value of the feedback correction coefficient;

judging as to whether the reference value is within a predetermined range when the throttle valve is fully closed increasing an obstruction compensating learning correction coefficient when the judging is made that the reference value is within the predetermined range and the mean value of the feedback correction coefficient reaches a predetermined value, and decreasing the obstruction compensating learning correction coefficient when the judging is made that the reference value is within the predetermined range and the mean value of the feedback correction coefficient less than the predetermined value; and determining a final fuel injection time duration in accordance with the basic fuel injection time duration and the obstruction compensating learning correction coefficient, whereby fuel is injection for the final fuel injection time duration.

8. A method of controlling an air-fuel ratio as set in claim 7, wherein, when the measured air-fuel ratio is on the rich side, the feedback correction coefficient is computed in a manner to approach a value less than 1.0 and, when the measured air-fuel ratio is on the lean side, the feedback correction coefficient is computed in a manner to approach a value being 1.0 or more.

9. A method of controlling an air-fuel ratio as set forth in claim 8, wherein the reference value is set at 1.0 at the time of the start of an engine, and, only when the reference value is 0.98 or more or 1.02 or less, the predetermined number is added to or subtracted from the obstruction compensating learning correction coefficient.

10. A method of controlling an air-fuel ratio as set forth claim 7, wherein, after the predetermined number is added to or subtracted from the obstruction compensating learning correction coefficient, a predetermined value is added to the reference value.

11. A method of controlling an air-fuel ratio as set forth in claim 7, wherein:

the air-fuel ratio is detected by an oxygen sensor for outputing an air-fuel ratio signal in accordance with a concentration of oxygen in the exhaust gas, said air-fuel ratio signal being low level when the concentration of oxygen is high and being high level when the concentration of oxygen is low;

when the air-fuel ratio signal becomes lower than a predetermined reference value, a comparatively high value is added to the feedback correction coefficient to be skipped, and until the air-fuel ratio reaches the predetermined reference value or more, a comparatively low value is added to the feedback correction coefficient;

when the air-fuel ratio reaches the predetermined reference value or more, a comparatively high value is subtracted from the feedback correction coefficient to be skipped, and until the air-fuel ratio becomes lower than the predetermined reference value, a comparatively low value is subtracted from the feedback correction coefficient.

12. A method of controlling an air-fuel ratio as set forth in claim 11, wherein the mean value of the feedback correction coefficient is computed by an arithmetical mean of the feedback correction coefficients immediately before two successive skips of the feedback correction coefficient.

* * * * *